US006213716B1

(12) United States Patent
Bucher et al.

(10) Patent No.: US 6,213,716 B1
(45) Date of Patent: Apr. 10, 2001

(54) FOLDING FAN

(75) Inventors: Charles E. Bucher, Valrico; John C. Bucher, Ft. Lauderdale, both of FL (US)

(73) Assignee: King of Fans, Inc., Ft. Lauderdale, FL (US)

( * ) Notice: Subject to any disclaimer, the term of this patent is extended or adjusted under 35 U.S.C. 154(b) by 0 days.

(21) Appl. No.: 09/443,776

(22) Filed: Nov. 19, 1999

(51) Int. Cl.[7] ..... F04D 29/26
(52) U.S. Cl. ..... 416/142; 416/210 R; 416/244 R
(58) Field of Search ..... 416/5, 210 R, 416/142, 244 R

(56) References Cited

U.S. PATENT DOCUMENTS

| | | | | |
|---|---|---|---|---|
| 1,194,413 | * | 8/1916 | Nesseler | 416/142 |
| 1,361,785 | * | 12/1920 | Tucker | 416/142 |
| 1,583,864 | * | 5/1926 | Tucker | 416/142 |
| 2,559,831 | * | 7/1951 | Roffy | 416/142 |
| 2,771,259 | | 11/1956 | Laystrom | 248/28 |
| 2,965,180 | | 12/1960 | Killam | 416/210 |
| 3,401,874 | * | 9/1968 | Covington | 416/142 |
| 4,050,771 | | 9/1977 | Watson | 339/263 |
| 4,121,495 | | 10/1978 | Malo | 85/1 |
| 4,511,310 | | 4/1985 | Pearce | 416/134 |
| 4,776,761 | * | 10/1988 | Diaz | 416/5 |
| 5,108,260 | * | 4/1992 | Monrose, III et al. | 416/142 |
| 5,397,206 | | 3/1995 | Sihon | 411/544 |
| 5,462,412 | | 10/1995 | Scofield | 416/210 |
| 5,873,701 | | 2/1999 | Shiu | 416/205 |
| 5,927,945 | | 7/1999 | Chen | 416/5 |
| 5,944,486 | | 8/1999 | Hodgkins, Jr. | 416/210 |
| 5,944,487 | | 8/1999 | Pearce | 416/244 |
| 5,951,197 | | 9/1999 | Wu | 403/315 |
| 5,954,449 | | 9/1999 | Wu | 403/315 |
| 5,980,353 | | 11/1999 | Wu | 446/210 |
| 6,010,306 | | 1/2000 | Bucher et al. | 416/210 |
| 6,027,309 | * | 2/2000 | Rawls et al. | 416/5 |
| 6,027,310 | | 2/2000 | Kerr | 416/210 |
| 6,039,540 | | 3/2000 | Wu | 416/210 |
| 6,095,753 | | 8/2000 | Hsu | 416/207 |

FOREIGN PATENT DOCUMENTS

| | | | |
|---|---|---|---|
| 2 276 219 | 9/1994 | (GB) | 267/141 |

* cited by examiner

*Primary Examiner*—Edward K. Look
*Assistant Examiner*—Ninh Nguyen
(74) *Attorney, Agent, or Firm*—Brian S. Steinberger; Law Offices of Brian S. Steinberger

(57) ABSTRACT

Ready to hang ceiling fans that do not require any assembly from the shipping box. A first embodiment has foldable mounting arms for each of the fan blades so that an installer takes both the motor and pre-attached blades out of a shipping box and allows the folded arms to unfold when the ceiling fan is being mounted. Another embodiment has foldable blades pre-attached to mounting arms that are attached to a motor housing. An installer simply takes both the motor and pre-attached folded blades out of a shipping box and allows the folded blades to unfold when the ceiling fan is being mounted. A still another embodiment combines both the foldable mounting arms and blades together. The shipping box has no separate packaging for blade fasteners and reduces the packaging approximately forty percent over conventional ceiling fan shipping boxes. Blades also do not have to be removed from the motor when the ceiling fan is being taken down and repackaged.

19 Claims, 10 Drawing Sheets

Fig. 4C
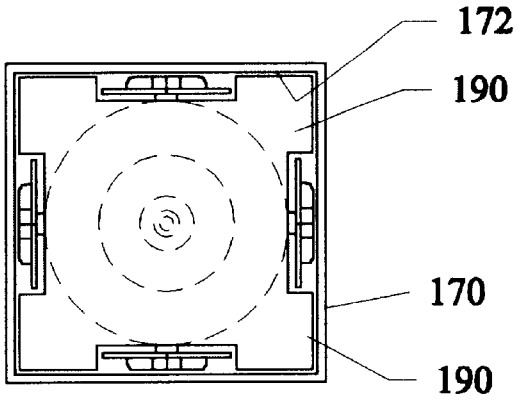
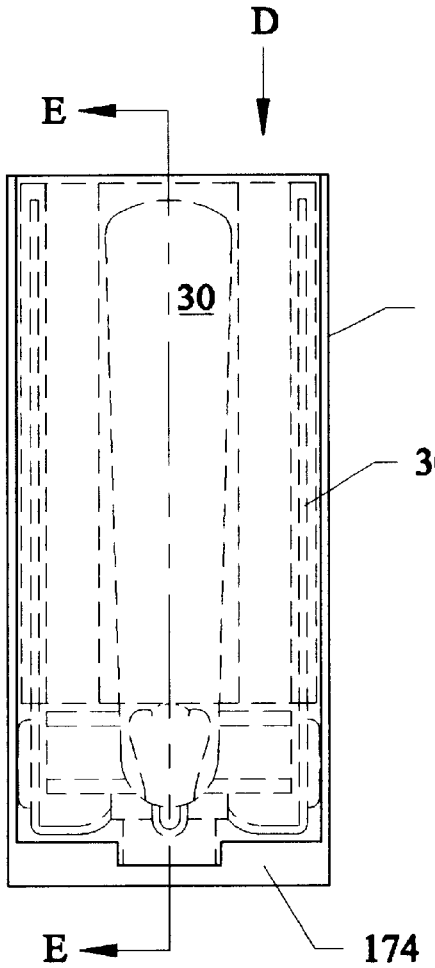
Fig. 4B
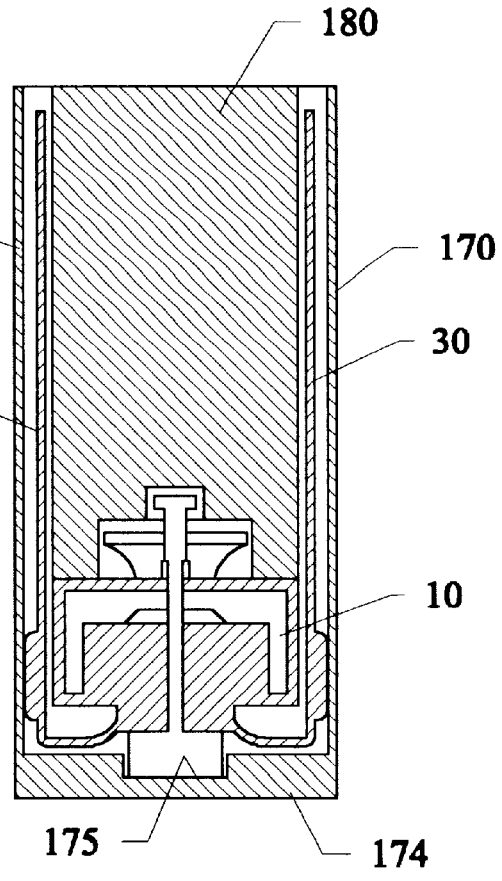
Fig. 4D

FOLDING FAN

This invention relates to ceiling fans, and in particular to pre-assembled ceiling fans having foldable blades and mounting arms that are factory installed onto the ceiling fan motor and packed in a ready to hang unit so that the ceiling fan can immediately be hung when removed from their package cartons.

BACKGROUND AND PRIOR ART

Store bought ceiling fans usually are shipped in cartons having separate packing materials such as foam inserts for the multiple components that must be assembled by the installer when the ceiling fan is made ready to be hung. It is common that at the least the ceiling fan blades are detached from the motor housing and along with blade fasteners such as screws are separately packed in the shipping carton.

Generally each conventional ceiling fan blade generally requires some five fasteners such as screws for the assembly process. Thus, the cartons that carry the ceiling fans from the store to the installation location must have separate packaging for twenty screws for a four blade fan, and twenty-five screws if the fan has five blades. Clearly, problems can further occur if only one fastener(screw) is missing.

Additionally, the boxed ceiling fan generally uses separate packaging for the blades and the blade arms. Extra foam inserts and additional manufacturing costs occur for each separate part that must be packaged. Thus, the installer has multiple loose parts and packaging materials when the store bought ceiling fan is first taken out of the carton.

In addition to having multiple loose parts, a typical installer must follow a tedious process in order to assemble and hang the ceiling fan. In FIG. 1, a conventional ceiling fan motor housing 10 has a rotor component 20 that rotates about a central axis within motor housing 10, which is in turn connected to a hanger assembly 5 that is attached beneath a ceiling 2. A plurality of fan blades 30 are connected to the rotor 20 by mounting arms 40. Each mounting arm 40 has one end 42 connected to an end 32 of each fan blade 30, and a second end 44 having at least two through-holes 45 therethrough, so that conventional fasteners such as screws 50 pass through the through-holes 45 to mateably thread into threaded holes 25 in the bottom of rotor 20.

Usually most conventional directions have the installer first connect and hang the motor housing 10, rotor 20 and hanger assembly 5 to a ceiling. More often than not the installer is usually perched on a stool or ladder. Next, many directions have the installer attach the fan blades 30 to their respective mounting arms 40. Finally, one of the last steps is to connect the blade 30 and respective mounting arm 40 to the rotor 20 on the motor.

To finish this final assembly step takes great dexterity, patience, balance and time. In order for a single person 60 to be able to complete this final step, the installer 60 needs to hold in one hand 62 the fan blade 30 and already attached mounting arm 40, and to position a screw driver 70 to the heads of screws 50 with the other hand 64. The installer must be able to balance the mounting screws 50 on the tip of the screw driver 70, insert the screws upwardly though the holes 44 in the mounting arm, making sure not to accidentally drop the screws 50 and then screw the screws 50 into the mating holes 25 on the rotor 20 all while still holding the blade 30 and arm 40. This assembly requires the installer to have to constantly hold both hands 62 and 64 raised high above their head, while again standing on a stool or ladder.

Many problems occur from this traditional method of assembly and installation of the ceiling fan. Screws 50 can and do accidentally fall and become lost causing more time and more expense to finish the installation. The installer 60 often has to constantly re position the blade 30 and arm 40 in order to be able to properly line up the through-holes 45 in the mounting arms 40 with their respective mating holes 25 in the bottom of rotor 20. The blade 30 and mounting arm 40 have been known to fall on and cause injury to the user 60 during assembly. Additionally, the user can lose their balance and injure themselves as well as falling off the ladder and stool. Additional problems also occur after installation. For example, uneven tightening of each of the plural fasteners that connect the mounting arm to the motor has resulted in wobble effects when the ceiling fan system is running. Thus, these current assembly and installation steps has become known as a frustrating, undesirable, difficult, tedious, time consuming and sometimes dangerous for the installer.

The problem of extra packaging and loose parts previously discussed occurs again if and when the ceiling fan needs to be taken down and reboxed. In order to fit again in the original carton, each of the ceiling fan blades must be detached from the motor housing and the separate fasteners and separate blades must be repacked back into the original carton.

SUMMARY OF THE INVENTION

The first objective of the present invention is to provide a device to allow a single user to safely and easily install a pre-assembled ceiling fan to a ceiling.

The second object of this invention is to provide a ceiling fan that eliminates an installer from having to mount and align blades onto a ceiling fan motor.

The third object of this invention is to provide foldable ceiling fan blades that unfold when the ceiling fan is hung.

The fourth object of this invention is to provide a ceiling fan that requires less time to install compared to conventional packaged ceiling fans.

The fifth object of this invention is to provide a ceiling fan having foldable blades that can be taken down and packed into a box without detaching the blades from the motor housing.

The sixth object of this invention is to eliminate wobble effects when running the ceiling fan by having pre-attached factory mounted blades on the ceiling fan.

A first preferred embodiment of the novel invention includes a ceiling fan motor having a rotating member and at least two novel fan blades having foldable arms attached thereto, so that the ceiling fan can be directly hung from a ceiling, without any additional assembly. The invention further includes a novel packing box for allowing the ceiling fan with folding blades and arms to be stored without having to dismantle the blades and arms from the motor. A second embodiment has foldable blades that are pre-attached to the rotating member/rotor on the motor. A still another version combines both the folding arms and the folding blades so that the entire ceiling fan be packed more compactly into a smaller storage box. The pre-attached blades and mounting arms can be made of materials such as but not limited to plastic, wood, zinc die-cast metal, and the like.

Further objects and advantages of this invention will be apparent from the following detailed description of a presently preferred embodiment which is illustrated schematically in the accompanying drawings.

BRIEF DESCRIPTION OF THE FIGURES

FIG. 4B is a side view of the packaged ceiling fan of FIG. 4A.

FIG. 4C is a top view of FIG. 4B along arrow D.

FIG. 4D is a cross-sectional view of FIG. 4B along arrow E—E.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation. The drawings are shown without any pitch on the blade for simplicity only. Normally, ceiling fan blades can be adjusted to have some pitch.

Figure 2A:
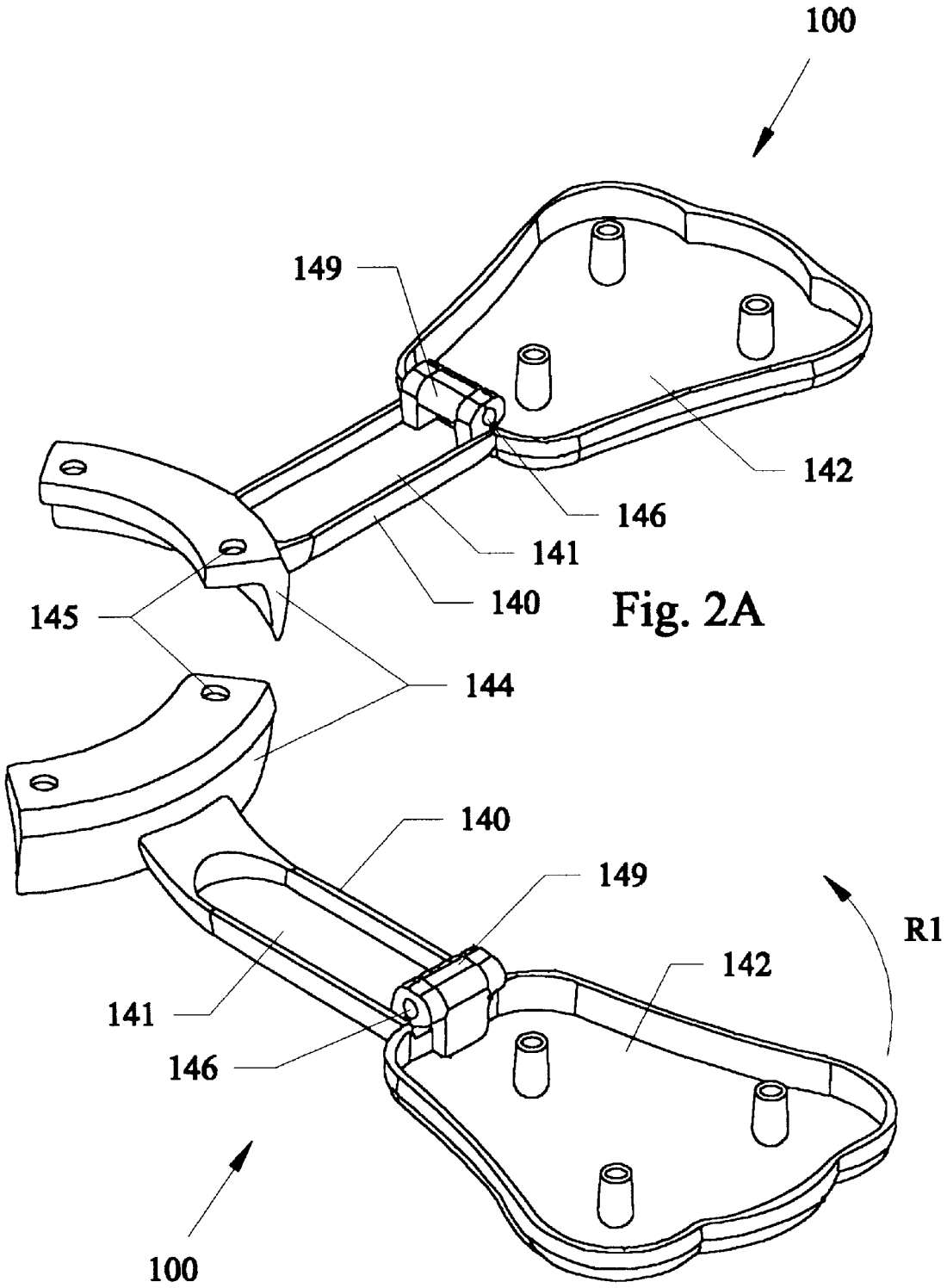
FIG. 2A is a perspective view of two foldable mounting arms for the invention in an unfolded position.
Figure 2B:
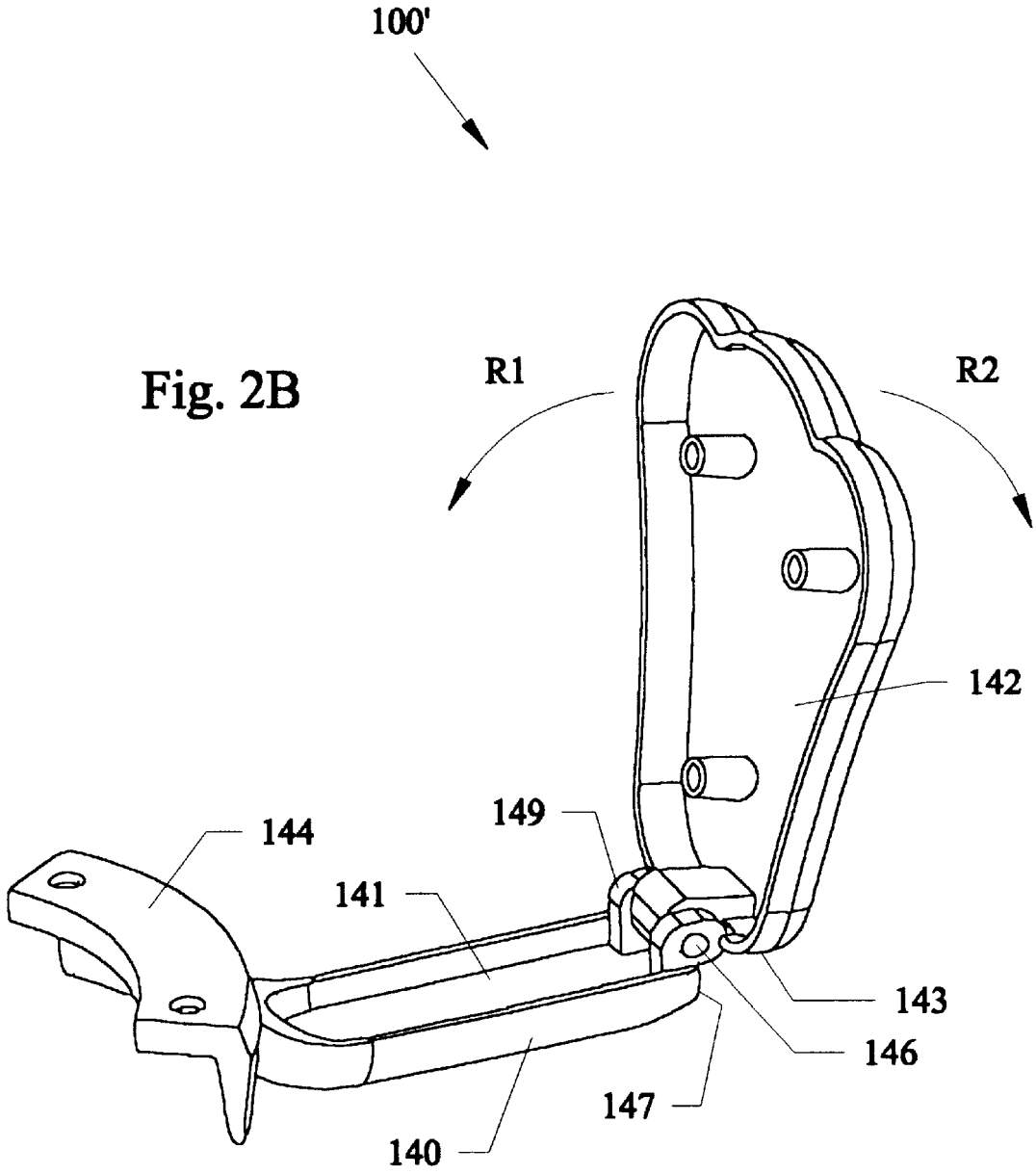
FIG. 2B is a view of one of the foldable mounting arms of FIG. 2A folded up.

FIG. 2A is a perspective view 100 of two foldable mounting arms 140 for the invention in an unfolded position. FIG. 2B is a view 100' of one of the foldable mounting arms 140 of FIG. 2A in a folded up position. Referring to FIGS. 2A–2B, mounting arm 140 includes one end 142 connected to an end of a fan blade 30, and a second end 144 having at least two through-holes 145 therethrough. The fan blade end 142 of mounting arm 140 is attached to the main trunk portion 141 by a hinge 149 having a pivoting pin 146 that allows the fan blade end 142 to fold up in the direction of arrow R1, and fold down in the direction of arrow R2. Outer edges 147, 143 of the mounting arm trunk 141 and fan blade end 142, respectively limit the fold down position of the mounting arm 140.

Figure 3A:
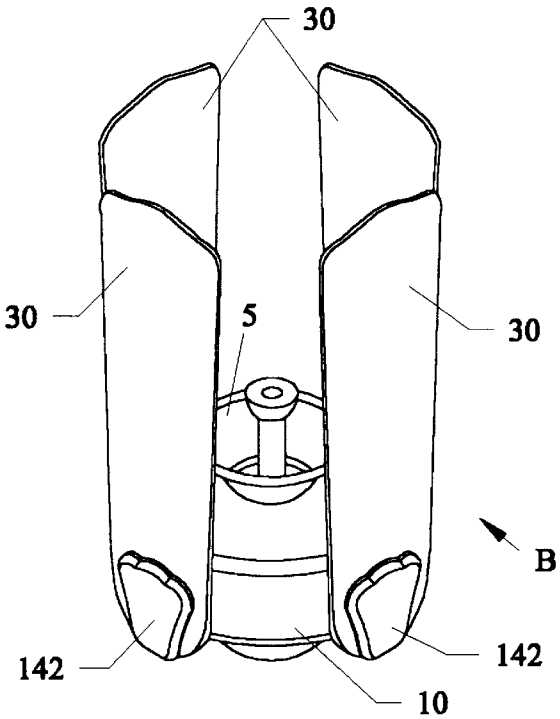
FIG. 3A is a perspective view of the foldable mounting arms of FIGS. 2A–2B attached to both blades and a motor.
Figure 3C:
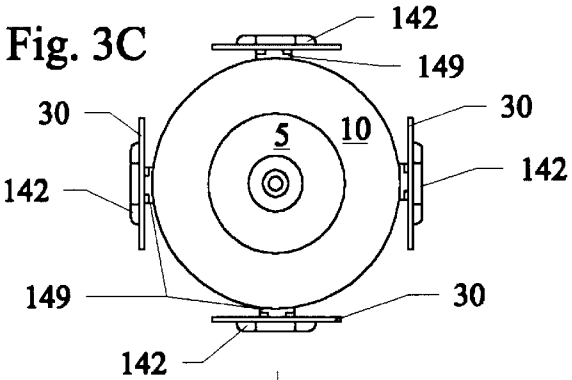
FIG. 3C is a top view of FIG. 3B along arrow C.
Figure 3B:
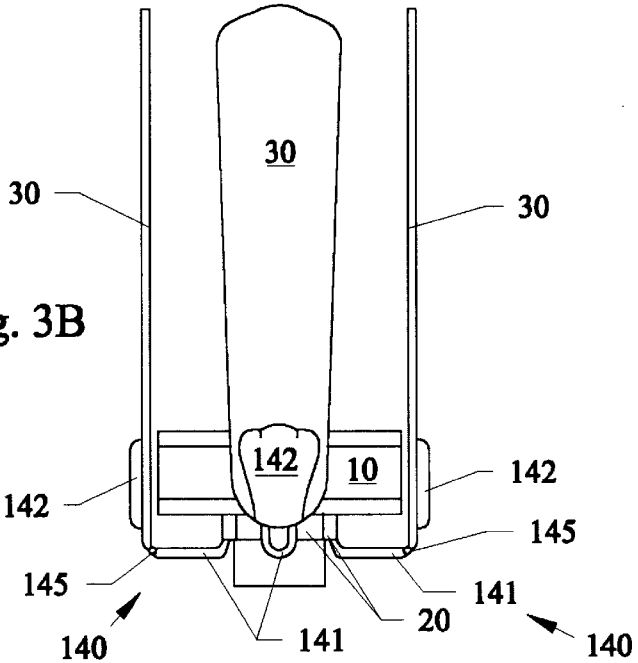
FIG. 3B is a side view of FIG. 3A along arrow B.

FIG. 3A is a perspective view of the foldable mounting arms of FIGS. 2A–2B attached to both the blades 30 and rotor component 20 within motor housing 10 of a ceiling fan in a folded up position. FIG. 3B is a side view of FIG. 3A along arrow B. FIG. 3C is a top view of FIG. 3B along arrow C. Referring to FIGS. 3A–3C, rotor component 20 rotates about a central axis within motor housing 10, which is in turn connected to a hanger assembly 5 that is attached beneath a ceiling 2, which are similar to those components previously described. A plurality of fan blades 30 are connected to the rotor 20 by foldable mounting arms 140.

Figure 4A:
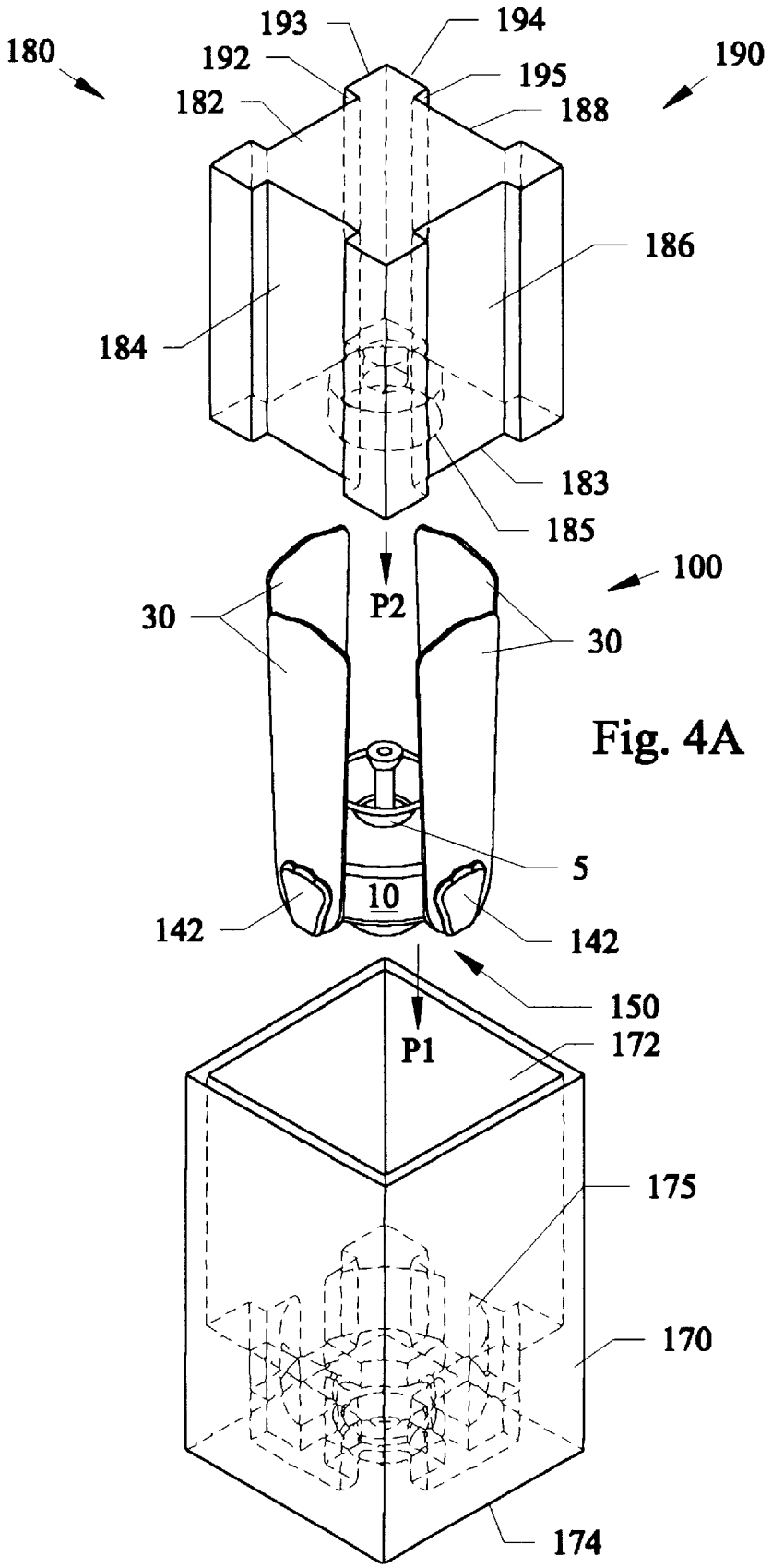
FIG. 4A is an exploded view of the folded mounting arms with blades and motor of FIGS. 3A–3C about to be packed into a single box.

FIG. 4A is an exploded view of the folded mounting arms 140 with blades 30 and motor housing 10 of FIGS. 3A–3C about to be packed into a single box 170. FIG. 4B is a side view of the packaged ceiling fan of FIG. 4A. FIG. 4C is a top view of FIG. 4B along arrow D. FIG. 4D is a cross-sectional view of FIG. 4B along arrow E—E.

Referring to FIG. 4A, storage box 170 can have a rectangular configuration with an open top portion 172 and a closed bottom 174, and an interior compartment having a bottom floor 175 that can be pre-molded to conform to the bottom shape irregular shape 150 of the folded ceiling fan blades 30 and the motor housing 10. Box 170 can be formed from pre-molded foam, and the like. Alternatively, box 170, can be separately inserted into another box(not shown) such as one made of cardboard, and the like, and having a closing cover lid. A separator insert 180 can be formed from a pre-molded foam having four corners 190 having rectangular configurations 192, 193, 194, 195, 196, flat sides 182, 184, 186, 188 and partially closed bottom 183 having a circular opening 185 therethrough. When packaged at the factory, the folded ceiling fan 100' can be inserted into the compartment 172 of box 170 by being moved downward in the direction of arrow P1. Next, separator insert 180 is moved downward in the direction of arrow P2 until opening 185 fits about hanger assembly 5 and abuts against the upper surface of ceiling fan motor housing 10. Corners 190 are sized to so that folded up blades 30 are kept separated from one another and uniformly in place. To remove the ceiling fan from the box 170, the above steps are reversed.

Figure 5A:
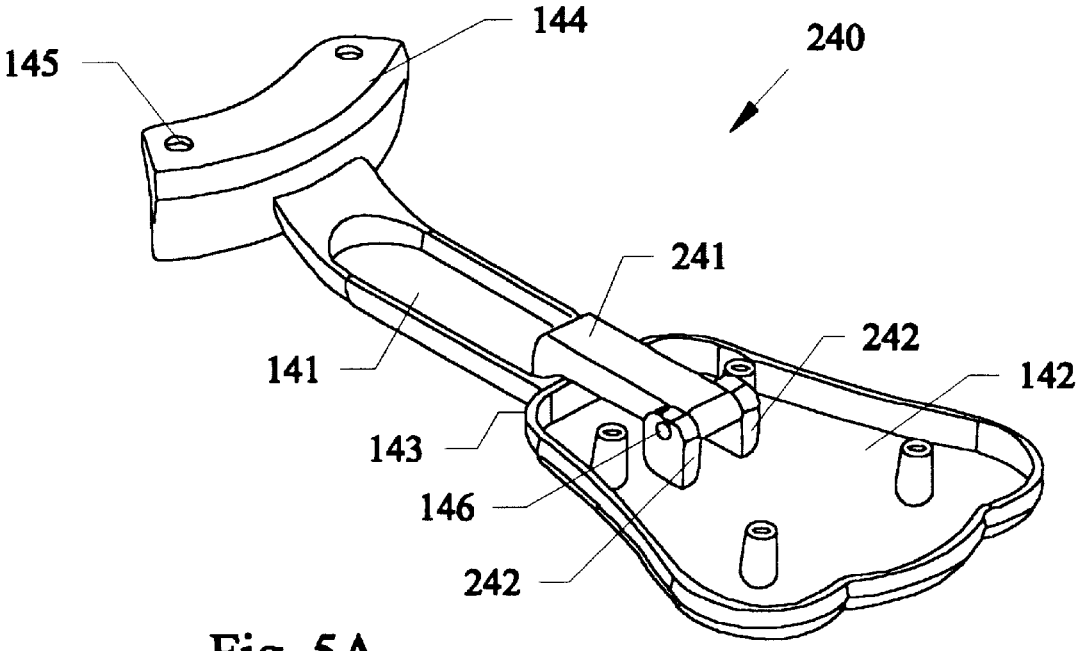
FIG. 5A is a view of a second preferred embodiment of foldable mounting arms.
Figure 5B:
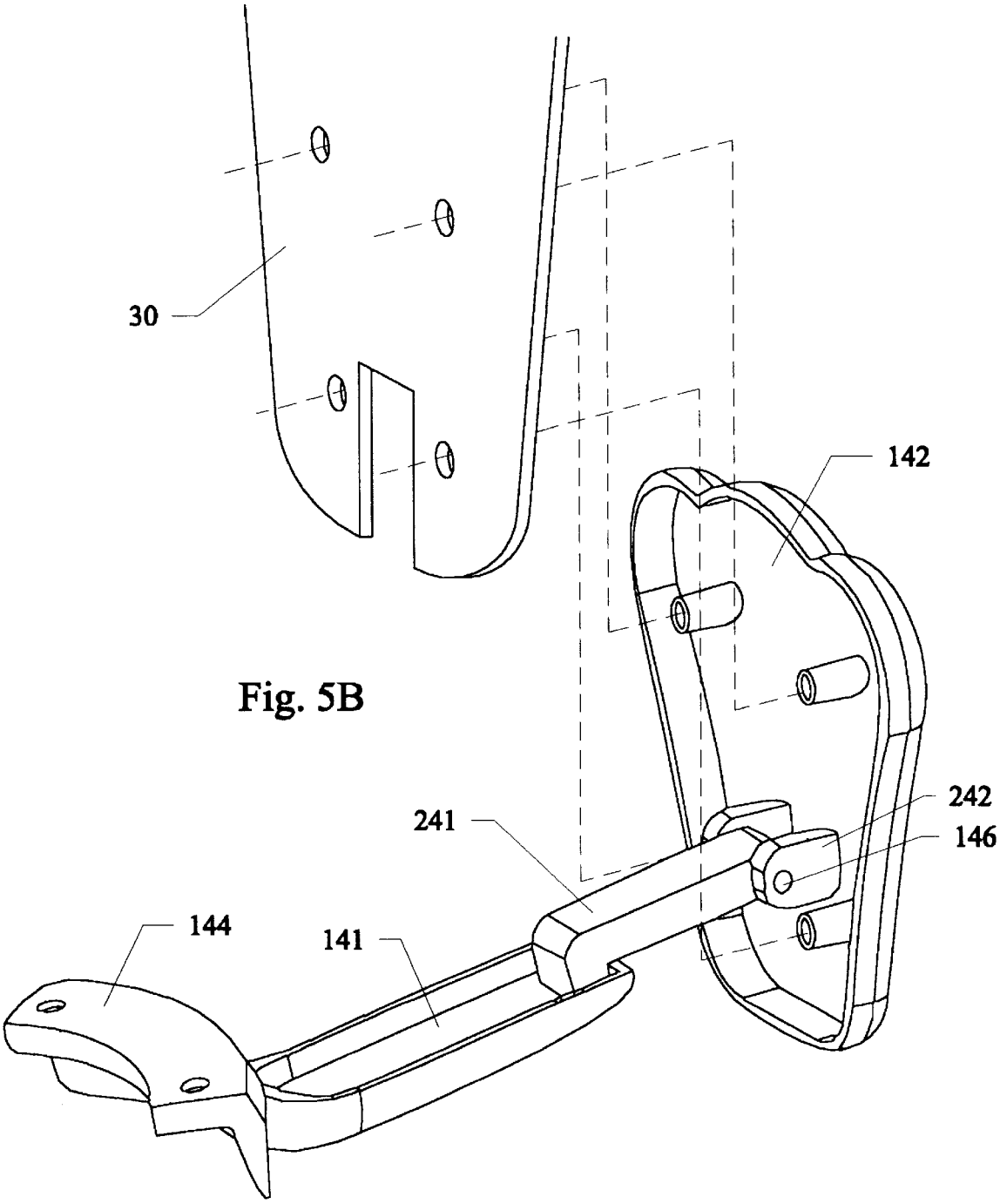
FIG. 5B is a view of a single foldable mounting arm of FIG. 5A folded up.

FIG. 5A is a view of a second preferred embodiment 240 of the foldable mounting arms. FIG. 5B is a view of a single foldable mounting arm 240 of FIG. 5A folded up with a blade detached. Referring to FIGS. 5A-5B, mounting arm 240 has the same rotor mounting end 144, trunk portion and fan blade end 142 as the preceding embodiment. Here, an L-shaped extension leg 241 is connected to the trunk 141, and an opposite end is connected to hinge mounts 242 approximately one third beyond the rear edge 143 of blade mount end 142. A pin 146 in the hinge assembly 241, 242 allows the blade mount end 142 to pivot and fold upward relative to trunk portion 141 of the mounting arm 240. This embodiment allows the folded up blades to be able to be stored in smaller boxes. A portion of the fan blade end hangs below the hinge allowing a box with a shorter height to be used. This embodiment can be used with a larger motor housing than those previously described without having to use a longer main trunk portion 141 which allows one to keep a simple aesthetic look and the same blade size.

Figure 1:
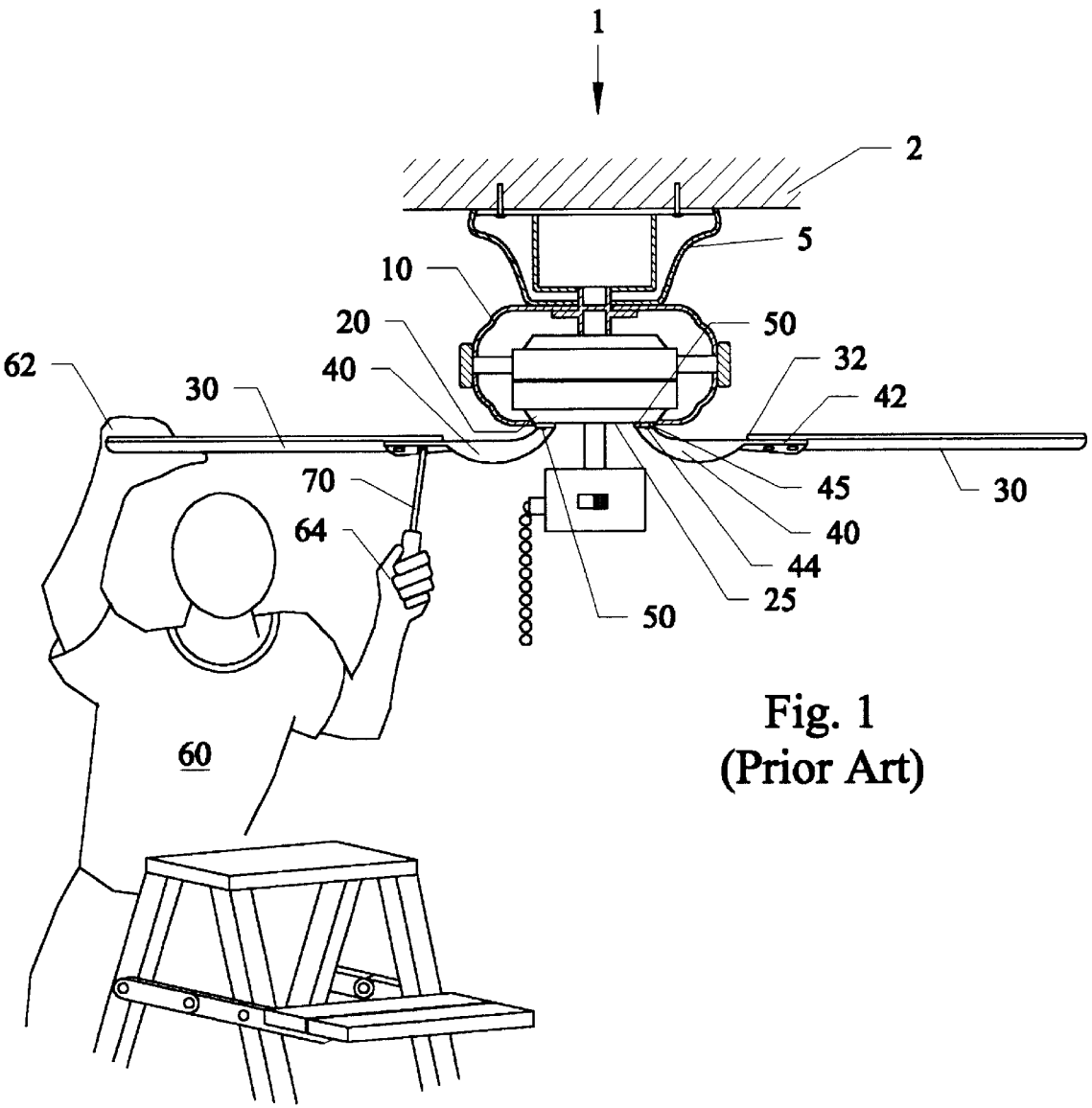
Fig. 1 (Prior Art)
FIG. 1 shows a prior art view of a blade with mounting arm attached to ceiling fan motor and rotor.
Figure 6A:
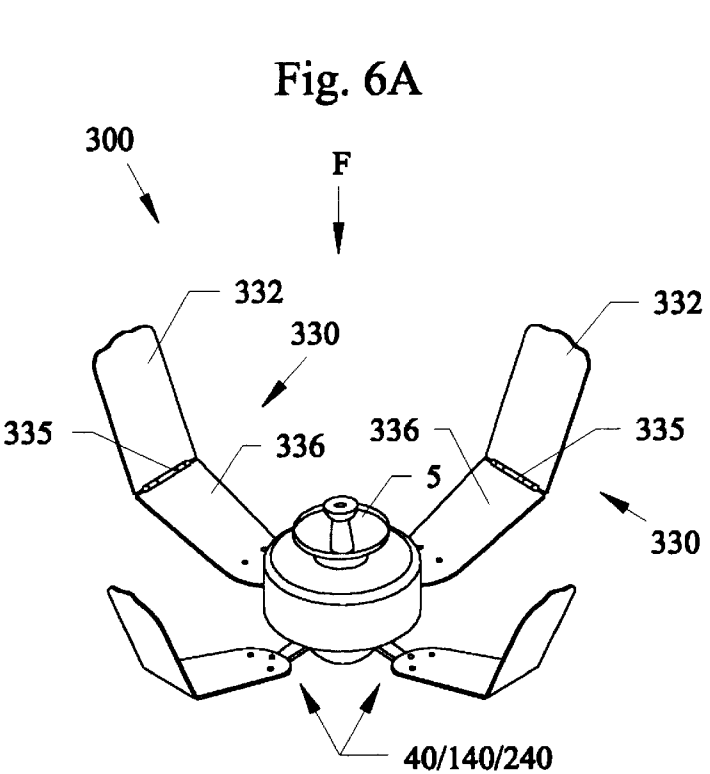
FIG. 6A is a perspective view of another embodiment having foldable blades.
Figure 6B:
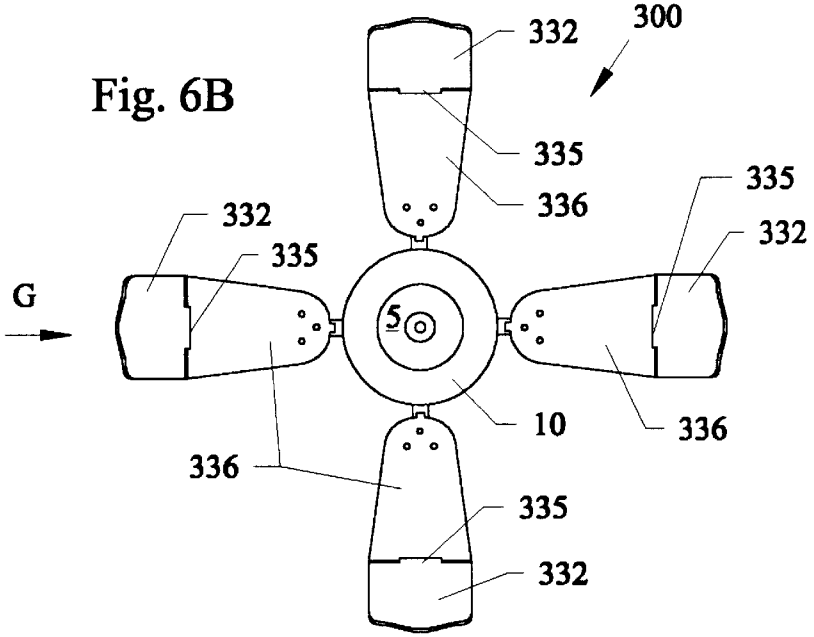
FIG. 6B is a top view of FIG. 6A along arrow F.
Figure 6C:
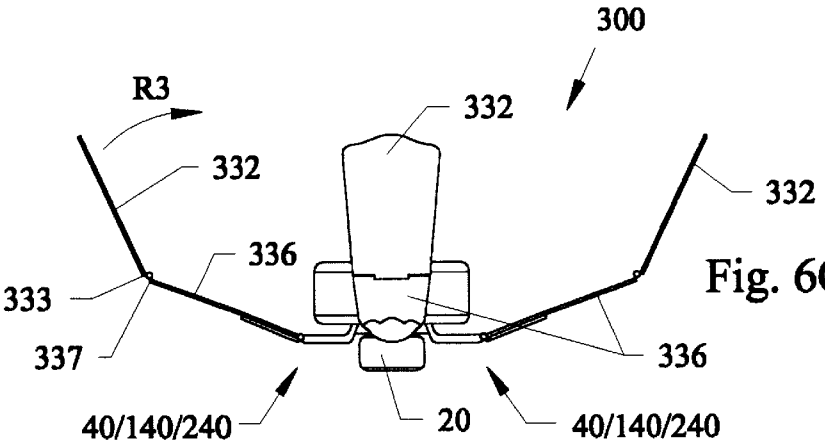
FIG. 6C is a side view of FIG. 6A along arrow G.

FIG. 6A is a perspective view of another embodiment 300 having foldable blades 330. FIG. 6B is a top view of FIG. 6A along arrow F. FIG. 6C is a side view of FIG. 6A along arrow G. Referring to FIGS. 6A–6C, embodiment 300 includes blades 330 where each blade has two sections: an outer portion 332 and an inner portion 336 connected to one another by hinges 335. Outer portion 332 has a flat inner side edge 333 and inner blade portion 336 has a flat outer edge portion 337 that limit the unfolded position of the blades 330. Outer blade portion can fold upward in the direction of arrow R3 to be in a folded position. The mounting arms that can connect the blades 330 to the rotor portion 20 of motor housing 10 can be a conventional mounting arm 40(such as that described and shown in reference to FIG. 1). Alternatively, the mounting arm can itself be one of the foldable mounting arms 140, 240 that were previously described.

Figure 7A:
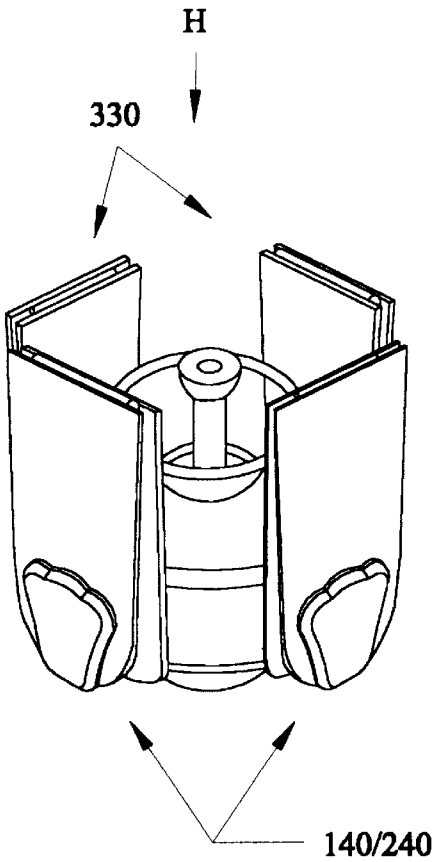
FIG. 7A is a perspective view of FIGS. 6A–6C having both the blades and the mounting arms folded up ready for packing.
Figure 7B:
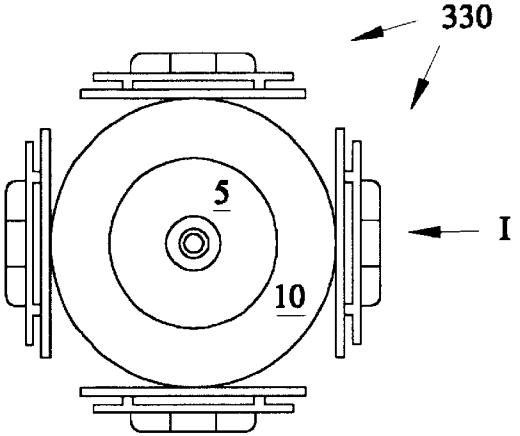
FIG. 7B is a top view of FIG. 7A along arrow H.
Figure 7C:
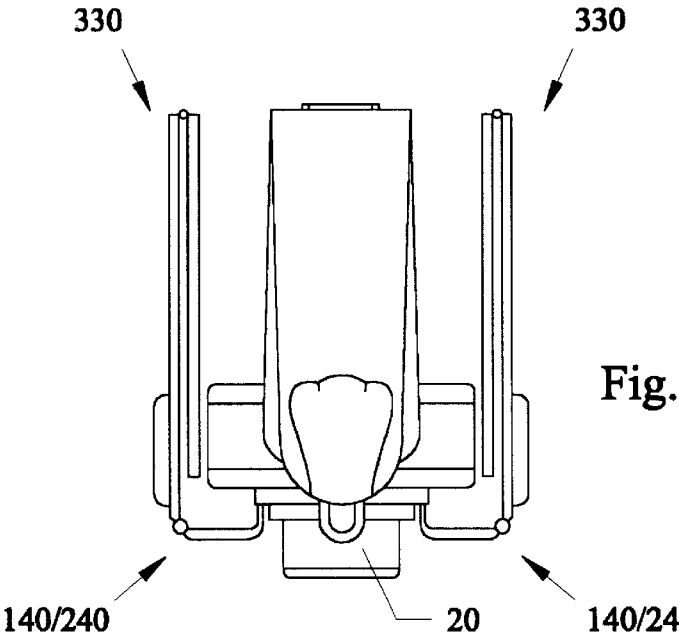
FIG. 7C is side view of FIG. 7B along arrow I.

FIG. 7A is a perspective view of FIGS. 6A–6C having both the blades 330 and the mounting arms 140/240 folded up ready for packing. FIG. 7B is a top view of FIG. 7A along arrow H. FIG. 7C is side view of FIG. 7B along arrow I. The folded assembly of FIGS. 7A–7C can be packed and unpacked in boxed similar to that described in reference to FIGS. 4A–4D.

Although the preferred embodiments show four foldable blades, the invention can be practiced with two, three, five and more foldable blades attached to the ceiling fan motor.

A canopy downrod and optional light kit(not shown) can also be pre-installed so that the ceiling fan and a light kit can be ready to hang right out of a shipping box.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A ceiling fan with folding parts, comprising in combination:

a ceiling fan motor having a rotating member;

a first foldable ceiling fan blade and arm attached to the rotating member having a first blade with one portion which folds over another portion to form a first folded blade, and a first arm with one portion which folds over another portion that forms a first folded arm; and a second foldable ceiling fan blade and arm attached to the rotating member having a second blade with one portion which folds over another portion to form a second folded blade, and a second arm with one portion which folds over a second portion to form a second folded arm, wherein the first folded blade is pre-attached to the first folded arm, the second folded blade is pre-attached to the second folded arm, and the first arm and the second arm are pre-attached to the ceiling fan motor in a stored position and are unfolded to be used.

2. The ceiling fan with folding parts of claim 1, further comprising:

a third foldable ceiling fan blade and arm attached the rotating member.

3. The ceiling fan with folding parts of claim 2, further comprising:

a fourth foldable ceiling fan blade and arm attached the rotating member.

4. The ceiling fan with folding parts of claim 3, further comprising:

a fifth foldable ceiling fan blade and arm attached the rotating member.

5. The ceiling fan with folding parts of claim 1, further comprising:

a packing box for allowing the first folded blade, the first folded arm, the second folded blade, and the second folded arm to be stored without having to dismantle the first blade, the first arm, the second blade, and the second arm from the motor.

6. The ceiling fan with folding parts of claim 5, further comprising:

packing means for separating the first blade and the second blade from one another in the box.

7. A ready to install ceiling fan, comprising in combination:

a ceiling fan motor having pre-attached blades thereon;

a single box for holding the ceiling fan motor and the pre-attached blades; and packing means for separating the pre-attached blades from one another inside the box.

8. The ready to install ceiling fan of claim 7, wherein each of the pre-attached blades include:

foldable blades.

9. The ready to install ceiling fan of claim 7, wherein each of the pre-attached blades include foldable mounting arms.

10. The ready to hang ceiling fan of claim 7, wherein each of the pre-attached blades include:

foldable mounting arms and foldable blades.

11. A ceiling fan with folding blades, comprising in combination:

a ceiling fan motor having a rotating member;

a first ceiling fan blade having a first folding portion attached to the rotating member for forming a first folded fan blade;

a second ceiling fan blade having a second folding portion attached to the rotating member for forming a second folded fan blade, wherein the first folding portion and the second folding portion allow the ceiling fan to be stored, and unfolding of the first folding portion and unfolding of the second folding portion allow the ceiling fan to be used;

a single box for holding the stored ceiling fan; and packing means for separating the first folded fan blade and the second folded fan blade from one another in the box.

12. A ceiling fan blade with folding blade arms, comprising in combination:

a ceiling fan motor having a rotating member;

a first ceiling fan blade and a first folding arm attached to the rotating member for forming a first folded arm;

a second ceiling fan blade and a second folding arm attached to the rotating member for forming a second folded arm, wherein the first folded arm and the second folded arm allow the ceiling fan to be stored, and unfolding of the first folding arm and unfolding of the second folding arm allows the ceiling fan to be used:

a single box for holding the stored ceiling fan; and packing means for separating the first ceiling fan blade and the second ceiling fan blade from one another in the box.

13. A method of packing ceiling fans, comprising the steps of:

positioning a ceiling fan having pre-attached blades into a box; and inserting material into the box to separate the pre-attached blades from one another, wherein the ceiling fan is packed in the box without having to dismantle the pre-attached blades from the ceiling fan.

14. The method of packing ceiling fans of claim 13, further including the step of:

folding the pre-attached ceiling fan blades.

15. The method of packing ceiling fans of claim 13, further including the step of:

folding mounting arms on the pre-attached blades.

16. A method of installing ceiling fans comprising the steps of:

removing a ceiling fan having pre-attached blades from a box;

expanding the pre-attached blades outward; and hanging the ceiling fan having the pre-attached blades to a ceiling mount.

17. The method of installing ceiling fans of claim 16, further including the step of:

removing material from the box which separates the pre-attached ceiling fan blades from one another.

18. The method of installing the ceiling fans of claim 16, the expanding step includes:

unfolding folded portions on the pre-attached ceiling fan blades.

19. The method of installing the ceiling fans of claim 16, the expanding step includes:

unfolding folded portions on arms attached to the pre-attached ceiling fan blades.

* * * * *